US006014541A

United States Patent [19]

Kato et al.

[11] Patent Number: 6,014,541

[45] Date of Patent: Jan. 11, 2000

[54] DEVICE FOR RECOVERING TONER IN AN IMAGE-FORMING MACHINE

[75] Inventors: Hisahiro Kato; Masahiro Hashizume; Akinobu Nakahata; Michio Uchida; Shinya Kawakami, all of Osaka; Hiroshi Inui, Kokogawa, all of Japan

[73] Assignee: Mita Industrial Co., Ltd., Osaka, Japan

[21] Appl. No.: 09/110,254

[22] Filed: Jul. 6, 1998

[30] Foreign Application Priority Data

Aug. 4, 1997 [JP] Japan ..... 9-221213

[51] Int. Cl.[7] ..... G03G 21/10

[52] U.S. Cl. ..... 399/358; 399/360

[58] Field of Search ..... 399/123, 358–360, 399/120

[56] References Cited

U.S. PATENT DOCUMENTS 4,162,842 7/1979 Wu ..... 399/256
4,700,659 10/1987 Hirakura et al. ..... 399/254
4,941,022 7/1990 Ohmura et al. ..... 399/358
5,113,227 5/1992 Miyasaka ..... 399/358
5,128,724 7/1992 Hayashi et al. ..... 399/119
5,715,502 2/1998 Taniguchi et al. ..... 399/358

*Primary Examiner*—Sandra Brase
*Assistant Examiner*—William A. Noe
*Attorney, Agent, or Firm*—Smith, Gambrell & Russell, LLP

[57] ABSTRACT

A device for recovering toner in an image-forming machine includes a cleaning mechanism for removing the toner that remains on an image carrier, a toner conveyer mechanism for conveying the toner removed by said cleaning mechanism, and a toner recovery container for containing the toner conveyed by said toner conveyer mechanism. The toner conveyer mechanism includes a toner conveying pipe connected at its one end to said cleaning mechanism and having, at its other end, a toner discharge port that faces a toner reception port formed in said toner recovery container, a toner conveying member in the form of a coil arranged in said toner conveying pipe and is coupled at its one end to a rotary member, and a toner-scraping member mounted on the other end of said toner conveying member and rotates together with said toner conveying member.

8 Claims, 6 Drawing Sheets

DEVICE FOR RECOVERING TONER IN AN IMAGE-FORMING MACHINE

FIELD OF THE INVENTION

The present invention relates to a device for recovering toner. More specifically, the invention relates to a device for recovering toner, which removes the toner remaining on an image carrier after a toner image has been transferred and recovers the thus removed toner, in an image-forming machine such as electrostatic copying machine, laser printer, facsimile or the like of the type in which an electrostatic image formed on a photosensitive material is developed into a toner image which is then transferred onto a transfer paper.

DESCRIPTION OF THE PRIOR ART

In an electrostatic copying machine of the type in which an electrostatic latent image formed on a photosensitive material is developed into a toner image and is transferred onto a transfer member, there is provided a toner recovery device which removes the toner remaining on and adhering to the surface of the photosensitive material after the toner image has been transferred and recovers the thus removed toner. Such a toner recovery device is disclosed in, for example, Japanese Laid-Open Patent Publication No. 234620/1995. The toner recovery device disclosed in this publication comprises a cleaning mechanism for removing the toner remaining on and adhering onto the surface of the photosensitive material, a toner conveyer mechanism for conveying the toner removed by the cleaning mechanism, and a toner recovery container for containing the toner conveyed by the toner conveyer mechanism. As shown in FIGS. 13 and 14, the toner conveyer mechanism comprises a toner conveying pipe 101 which is connected at its one end to the cleaning mechanism, and a toner conveying member 102 of the form of a coil which is arranged in the toner conveying pipe 101 and is connected at its one end to a rotary member. At the other end of the toner conveying pipe 101 is formed a toner discharge port 101*a* which faces to a toner reception port 103*a* formed at the upper end of a toner recovery container 103.

The toner conveyer mechanism in the above-mentioned toner recovery device conveys the toner 100 removed by the cleaning mechanism through the toner conveying pipe 101 from one end thereof toward the other end thereof by the action of the toner conveying member 102 in the form of a coil, and permits it to fall by gravity in the toner recovery container 103 from the toner discharge port 101*a* through the toner reception port 103*a*. The toner that falls due to gravity in the toner recovery container 103 builds up in the form of a mountain as shown in FIG. 13, i.e., the toner can not be evenly contained in the toner recovery container 103. When the toner that has fallen spills over into the toner conveying pipe 101 beyond the toner reception port 103*a* and the toner discharge port 101*a* as shown in FIG. 14, the toner conveying member 102 in the form of a coil is compressed toward the one end thereof (toward the left in FIG. 14) by the toner. As a result, when the other end of the toner conveying member 102 moves toward the one end (toward the left in FIG. 14) from the toner discharge port 101*a*, it becomes no longer possible to convey the toner into the toner recovery container 103 by the toner conveying member 102. Therefore, the toner is contained in the toner recovery container 103 in the form of a mountain, resulting in a considerable space being formed in the upper portion of the toner recovery container 103. In consequence, the filling efficiency of the toner is low.

The capacity of the toner recovery container is determined by taking into consideration the capacity of the toner cartridge that is mounted in the developing device. That is, when the toner in the toner cartridge is consumed, the toner recovery container is replaced together with the toner cartridge and hence, the toner recovery container must have a capacity capable of holding the residual toner until the toner in the toner cartridge is all consumed. Furthermore, the residual toner increases with a decline in the transfer efficiency of the image-forming machine caused by a deterioration of operation environment and an increase in moisture of the transfer paper. Therefore, the capacity of the toner recovery container is determined also by taking these factors into consideration. In order to decrease the size of the whole image-forming machine, on the other hand, it is required to decrease the volume of the toner recovery container to as small as possible. Accordingly, it is desired to provide a toner recovery device having a toner conveyer mechanism capable of sending the toner to a toner recovery container highly efficiently.

SUMMARY OF THE INVENTION

A principal object of the present invention is to provide a device for recovering toner having a toner conveyer mechanism capable of sending the toner to a toner recovery container highly efficiently.

In order to accomplish the above-mentioned principal object, according to the present invention, there is provided a device for recovering toner in an image-forming machine, that comprises a cleaning mechanism for removing the toner that remains on an image carrier after a toner image has been transferred, a toner conveyer mechanism for conveying the toner removed by said clearing mechanism, and a toner recovery container for containing the toner conveyed by said toner conveyer mechanism, wherein:

said toner conveyer mechanism includes a toner conveying pipe connected at its one end to said cleaning mechanism and having, at its other end, a toner discharge port that faces to a toner reception port formed in said toner recovery container, and a toner conveying member in the form of a coil arranged in said toner conveying pipe and is coupled at its one end to a rotary member; and said toner conveying member in the form of a coil is arranged in a compressed state, and is supported at its other end by an end of said toner conveying pipe by using a support means having a low frictional resistance.

According to the present invention, there is further provided a device for recovering toner in an image-forming machine, that comprises a cleaning mechanism for removing the toner that remains on an image carrier after a toner image has been transferred, a toner conveyer mechanism for conveying the toner removed by said cleaning mechanism, and a toner recovery container for containing the toner conveyed by said toner conveyer mechanism, wherein:

said toner conveyer mechanism includes a toner conveying pipe connected at its one end to said cleaning mechanism and having, at its other end, a toner discharge port that faces to a toner reception port formed in said toner recovery container, a toner conveying member in the form of a coil arranged in said toner conveying pipe and is coupled at its one end to a rotary member, and a toner-scraping member mounted on the other end of said toner conveying member and rotates together with said toner conveying member.

Other objects and features of the present invention will become obvious from the following description.

DETAILED DESCRIPTION OF THE PREFERRED EMBODIMENTS

Preferred embodiments of the device for recovering toner constituted according to the present invention will now be described in detail with reference to the accompanying drawings.

Figure 1:
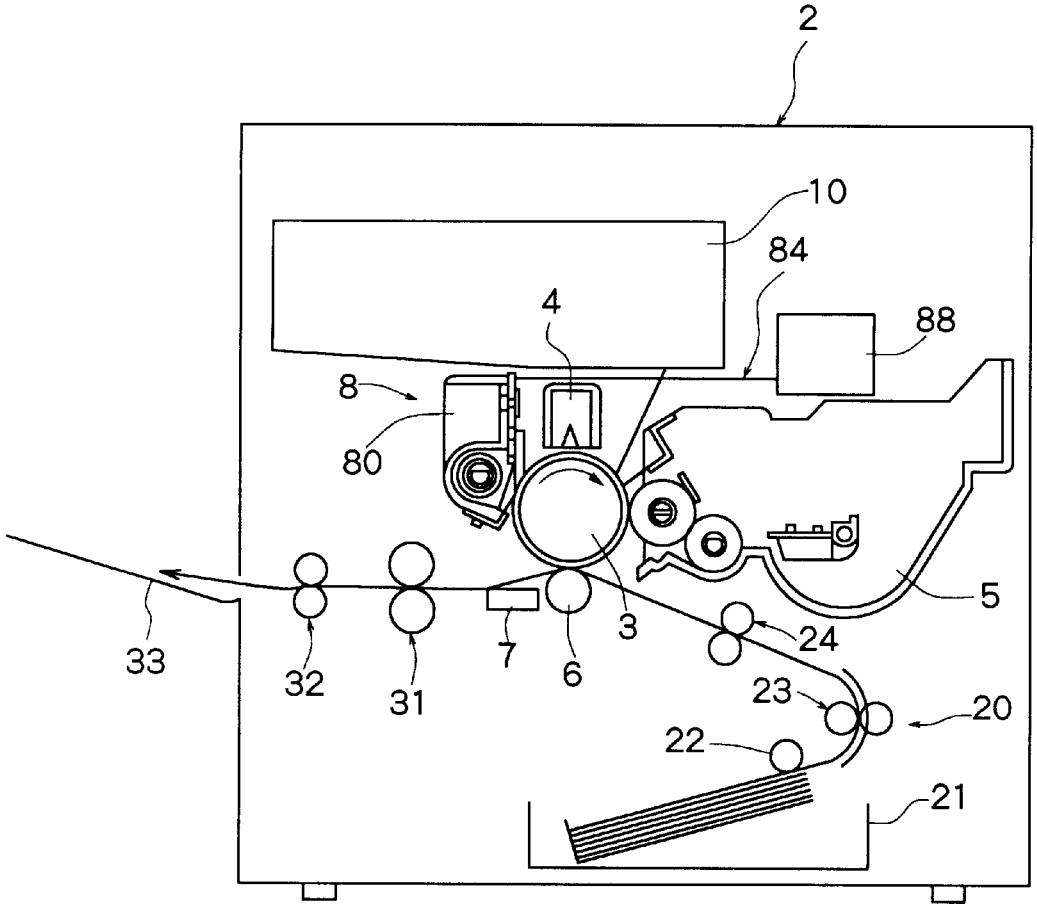
FIG. 1 is a view schematically illustrating the constitution of an image-forming machine equipped with a device for recovering toner according to the present invention.

FIG. 1 is a view schematically illustrating the constitution of an image-forming machine equipped with a device for recovering toner constituted according to the present invention.

The illustrated image-forming machine has a machine housing which is generally designated by the numeral 2. A photosensitive material drum 3 which is an image carrier having a photosensitive layer on the peripheral surface thereof, is rotatably arranged nearly at the central portion of the machine housing 2. The photosensitive material drum 3 is rotated in a direction indicated by an arrow by a drive means that is not shown. Around the photosensitive material drum 3, a corona discharger 4 for charging, a developer 5, a transfer roller 6, a charge-removing lamp 7 for peeling, and a cleaning mechanism 80 of a device 8 for recovering toner of the present invention, are disposed in this order as viewed in a direction of rotation indicated by the arrow. In an upper part of the machine housing 2 is disposed an optical unit 10 for exposing an image on the peripheral surface of the photosensitive material drum 3 to light, between a corona discharger 4 for charging and the developing device 5. The electrostatic copying machine that is shown includes a transfer paper-feeding device 20 for feeding transfer papers to a transfer zone between the photosensitive material drum 3 and the transfer roller 6. The transfer paper-feeding device 20 includes a transfer paper cassette 21 for containing transfer papers, a transfer paper-delivering roller 22, a pair of conveyer rollers 23, and a pair of resist rollers 24. The above-mentioned rollers of the thus constituted transfer paper-feeding device 20 are rotated by drive means that are not shown. A pair of fixing rollers 31 and a pair of discharge rollers 32 are disposed on the side of sending the transfer papers, of the transfer zone and are rotated by drive means that are not shown. A tray 33 is arranged on the discharge side (left side in the drawing) of the pair of discharge rollers 32.

In the thus constituted electrostatic copying machine, the corona discharger 4 substantially uniformly charges the photosensitive material on the photosensitive material drum 3 to a predetermined polarity while the photosensitive material drum 3 rotates in the direction of the arrow. Then, the photosensitive material drum 3 is scanned and is exposed to light from the optical unit 10, so that an electrostatic latent image is formed on the photosensitive material drum 3. Thereafter, the electrostatic latent image on the photosensitive material drum 3 is developed into a toner image by the developer 5. On the other hand, a transfer paper contained in the transfer paper cassette 21 in the transfer paper-feeding device 20 is delivered by the transfer paper-delivering roller 22 and is conveyed toward the pair of resist rollers 24 by the pair of conveyer rollers 23. The transfer paper conveyed toward the pair of resist rollers 24 is once halted and is then conveyed to the transfer zone in synchronism with the toner image formed on the photosensitive material drum 3. The transfer paper conveyed to the transfer zone passes through between the transfer roller 6 and the photosensitive material drum 3 on which the toner image is formed, whereby the toner image is transferred onto the transfer paper. The transfer paper onto which the toner image has been transferred is peeled off from the photosensitive material drum 3 by the action of the charge-removing lamp 7 for peeling, is conveyed to the pair of fixing rollers 31 where it is heated and fixed, and is discharged onto the tray 33 by the pair of discharge rollers 32. The residual toner adhering onto the peripheral surface of the photosensitive material drum 3 after the completion of the transfer step, is removed by the cleaning mechanism 80 as it passes through the cleaning mechanism 80 which constitutes the device 8 for recovering toner.

Next, a first embodiment of the device 8 for recovering toner will be described with reference to FIGS. 2 to 4.

The device 8 for recovering toner includes a cleaning mechanism 80 for removing the toner that remains on and adheres onto the peripheral surface of the photosensitive material drum 3 after the toner image has been transferred, a toner conveyer mechanism 84 for conveying the toner removed by the cleaning mechanism 80, and a toner recovery container 88 for containing the toner conveyed by the toner conveyer mechanism 84.

The cleaning mechanism 80 includes a cleaning housing 81, a cleaning blade 82 mounted on the cleaning housing 81, and a screw vane member 83 arranged in a toner conveying passage 811 formed in the cleaning housing 81.

The cleaning housing 81 is made of a suitable synthetic resin, and is arranged along the photosensitive material drum 3. The cleaning blade 82 is made of a soft material such as a synthetic rubber, is attached at its upper end to a part of the cleaning housing 81 by a suitable fastening means, and is pushed at its lower end onto the peripheral surface of the photosensitive material drum 3.

The screw vane member 83 is made of a suitable synthetic resin and is rotatably arranged in the toner conveying passage 811. An input gear 801 is fitted to an end on the front side of the screw vane member 83 (to the lower end in FIG. 3) and is drivably coupled, via an intermediate gear 802, to the drum gear 803 fitted to an end on the front side (lower end in FIG. 3) of the photosensitive material drum 3. As the photosensitive material drum 3 rotates in the direction indicated by the arrow, therefore, the screw vane member 83 is rotated in a direction indicated by an arrow via the drum gear 803 and the intermediate gear 802.

The thus constituted cleaning mechanism 80 removes the toner that remains on and adheres onto the peripheral surface of the photosensitive material drum 3 after the toner image has been transferred, by the action of the cleaning blade 82. The thus removed toner is caused to flow toward the toner conveying passage 811 in the cleaning housing 81, and is conveyed to the rearward (upper direction in FIG. 3) by the action of the screw vane member 83 which is rotated in the direction indicated by the arrow.

Next, described below is the toner conveyer mechanism 84.

The toner conveyer mechanism 84 is constituted by a toner conveying pipe 85 and a toner conveying member 86 in the form of a coil arranged within the toner conveying pipe 85. The toner conveying pipe 85 is made of a synthetic rubber such as an urethane rubber and is bent at an angle of about 90 degrees at its intermediate portion. At an end of the toner conveying pipe 85 is provided a connection portion 851 having a diameter larger than other portions. The connection portion 851 is fitted and connected to a cylindrical protrusion 812 that is provided in the wall on the rear side of the cleaning housing 81 and is communicated with the toner conveying passage 811. The other end of the toner conveying pipe 85 has a lower surface that is partly formed flat, and a toner discharge port 852 of a rectangular shape that is formed in this flat surface. The toner conveying member 86 in the form of a coil is made of a resilient coil member and is arranged in the toner conveying pipe 85 in a compressed state. The toner conveying member 86 in the form of a coil is engaged, at its one end with a mounting hole 831 formed in the rear end (upper end in FIG. 3) of the screw vane member 83 which is the rotary member, and rotates together with the screw vane member 83. The other end of the toner conveying member 86 in the form of a coil is supported by a plug 87, which is a support means, fitted to the other end of the toner conveying pipe 85. The surface of the plug 87 which is the support means opposed to the toner conveying member 86 comes into slide contact with the end of the toner conveying member 86. It is therefore important that at least the surface opposed to the toner conveying member 86 has a low frictional resistance. In the illustrated embodiment, therefore, the plug 87 is made of a synthetic resin having a small coefficient of friction. The plug 87 may be made of a metal, and the surface opposed to the toner conveying member 86 may be coated with a synthetic resin having a small coefficient of friction.

The toner recovery container 88 is made of a suitable synthetic resin, and in the upper surface thereof is formed a toner reception port 881 of a rectangular shape that faces to the toner discharge port 852. The toner recovery container 88 is detachably mounted in the machine housing 2 of the image-forming machine at a predetermined position on the lower side of the other end of the toner conveyer mechanism 84. The toner recovery container 88 is arranged in a space apart from the photosensitive material drum 3 and the cleaning mechanism 80 so that it is allowed to be attached and detached with ease. Therefore, the toner conveying pipe 85 is bent so as to pass through the machine housing 2 without interference by the photosensitive material drum 3 and the peripheral equipment. Since the toner recovery container 88 is mounted and removed, it is necessary to prevent the toner from flying out through the toner discharge port 852 formed in the toner conveying pipe 85 of the toner conveyer mechanism 84 when the toner recovery container 88 is not mounted. Therefore, a shutter mechanism such as the one disclosed in U.S. Pat. No. 5,708,952 is arranged in the toner conveying pipe 85 so as to move between a closed position where it closes the toner discharge port 852 and an open position where it opens the toner discharge port 852. This shutter mechanism, however, has no direct relationship to the present invention and hence, is not described here.

Figure 2:
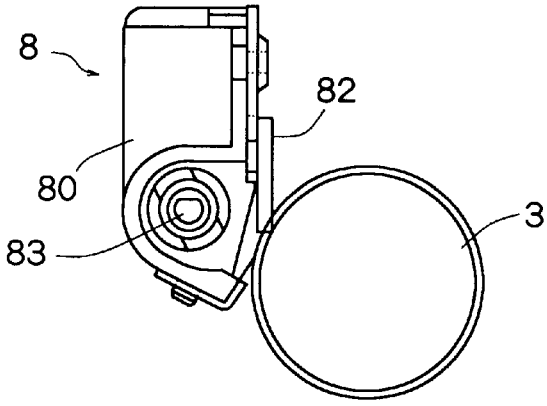
FIG. 2 is a side view of a cleaning means constituting the device for recovering toner according to the present invention.
Figure 3:
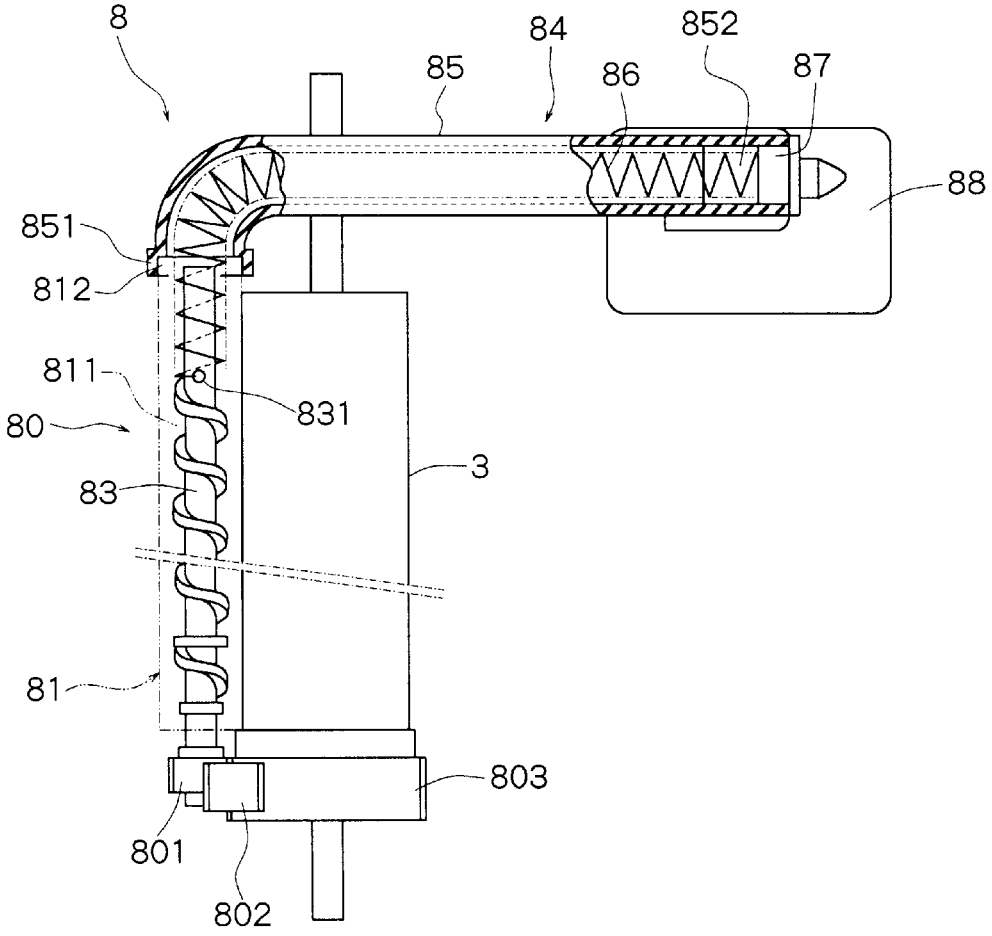
FIG. 3 is a plan view illustrating, in cross section, major portions of the device for recovering toner constituted according to a first embodiment of the present invention.
Figure 4:
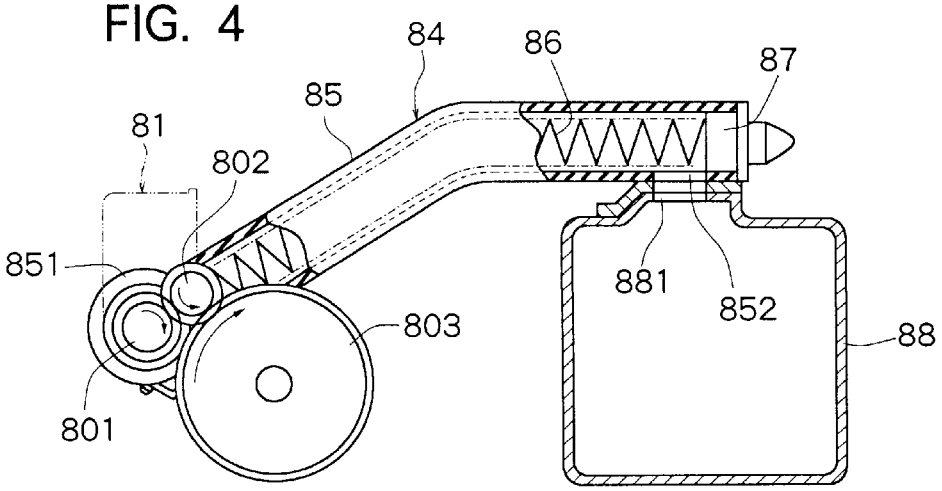
FIG. 4 is a side view illustrating, in cross section, major portions of the device for recovering toner shown in FIG. 3.
Figure 5:
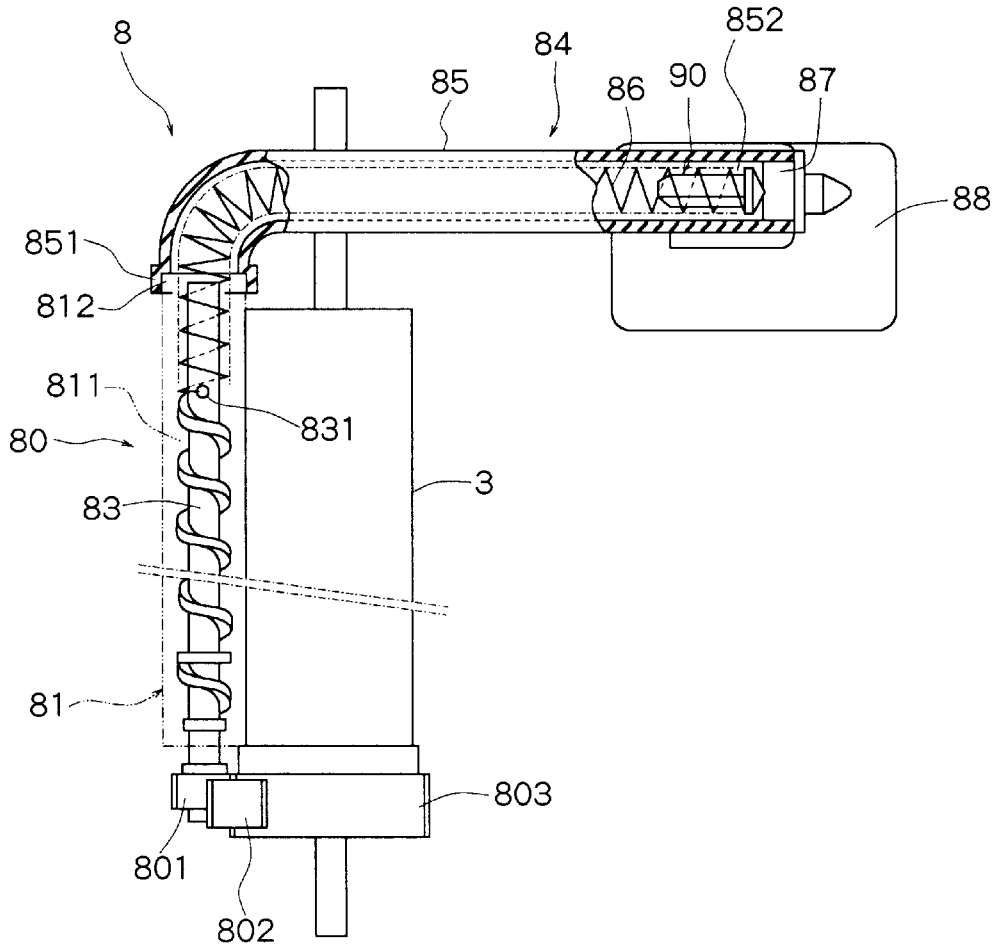
FIG. 5 is a plan view illustrating, in cross section, major portions of the device for recovering toner constituted according to a second embodiment of the present invention.
Figure 6:
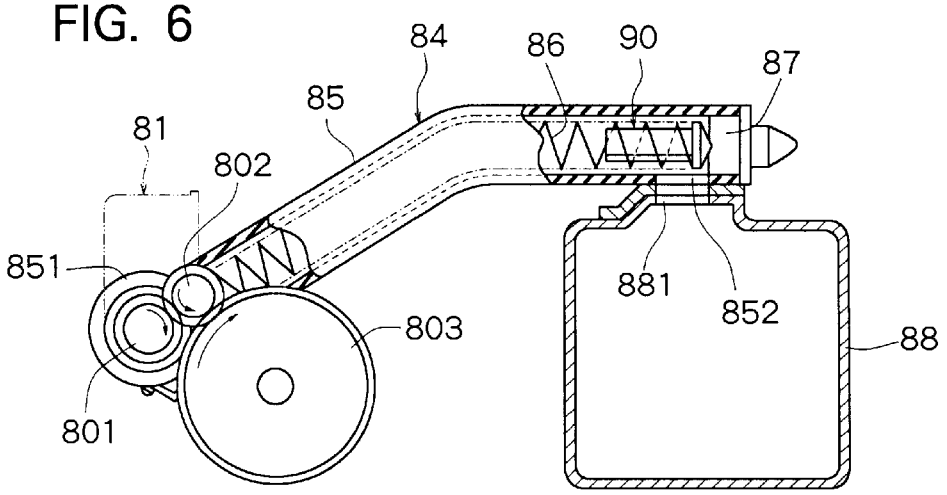
FIG. 6 is a side view illustrating, in cross section, major portions of the device for recovering toner shown in FIG. 5.
Figure 7:
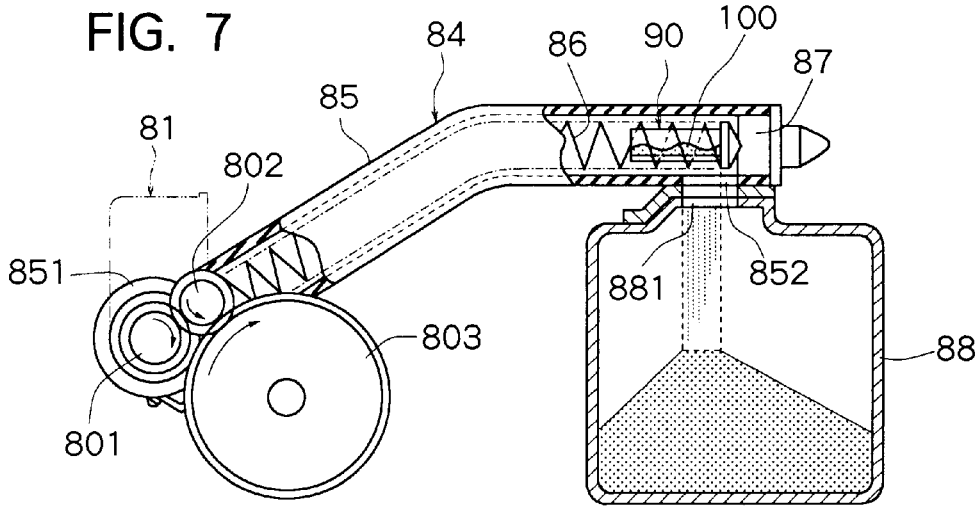
FIG. 7 is a side view illustrating, in cross section, major portions of the device for recovering toner shown in FIG. 5 which is in operation.

The device 8 for recovering toner of the embodiment shown in FIGS. 2 to 4 is constituted as described above and operates as described below.

After the toner image is transferred, the toner remaining on and adhering onto the peripheral surface of the photosensitive material drum 3 is removed by the cleaning blade 82. The removed toner flows toward the toner conveying passage 811 and is then conveyed through the toner conveying passage 811 to the rear side (upper direction in FIG. 3) by the action of the screw vane member 83 rotated in the direction of the arrow. The toner conveyed to the end on the rear side (upper end in FIG. 3) of the toner conveying passage 811, is then conveyed toward the toner discharge port 852 through the toner conveying pipe 85 due to the toner conveying member 86 in the form of a coil which is mounted at its one end on the end of the rear side (upper end in FIG. 3) of the screw vane member 83, and is permitted to fall into the toner recovery container 88 from the toner discharge port 852 through the toner reception port 881. Even though the toner is, thus, recovered in the toner recovery container 88 and partly overflows into the toner conveying pipe 85 through the toner reception port 881 and the toner discharge port 852, the toner conveying member 86 in the form of a coil is not pushed back toward the upstream side in the direction of conveying the toner (toward the left in FIGS. 3 and 4) by the toner that overflowed into the toner conveying pipe 85, because the toner conveying member 86 has been arranged in a compressed state in the toner conveying pipe 85. Therefore, the toner conveying member 86 continues to convey the toner removed from the peripheral surface of the photosensitive material drum 3 by the cleaning mechanism 80 toward the toner discharge port 852, at the same time, and works to flatten the toner that overflows through the toner reception port 881 of the toner recovery container 88, making it possible to enhance the filling efficiency in the toner recovery container 88. The toner conveying member 86 in the form of a coil is arranged in a compressed state and hence, its other end comes into slide contact with the plug 87. However, since the plug 87 has been made of a synthetic resin having a small coefficient of friction, the slide resistance is small between the toner conveying member 86 and the plug 87, enabling suppression of an increase in drive torque for rotating the toner conveying member 86.

The device 8 for recovering toner according to a second embodiment will now be described with reference to FIGS. 5 to 12. The second embodiment is substantially the same as the first embodiment except that a vane member is mounted on the other end of the toner conveying member 86 in the form of a coil of the above-mentioned first embodiment. Therefore, the same members denoted by the same reference numerals are not described here again.

Figure 8:
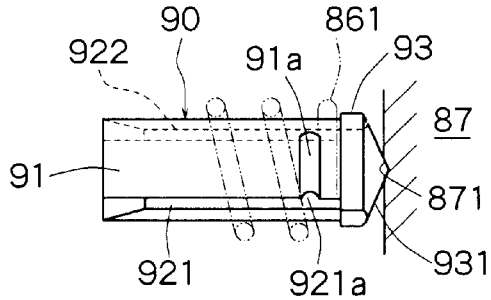
FIG. 8 is a front view of a vane member mounted on a toner conveyer mechanism in the device for recovering toner shown in FIG. 5 according to an embodiment of the present invention.
Figure 9:
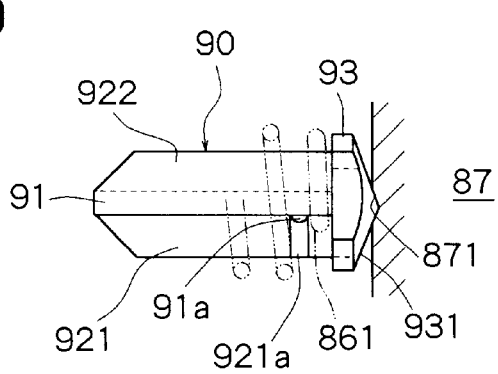
FIG. 9 is a plan view of the vane member shown in FIG. 8.
Figure 10:
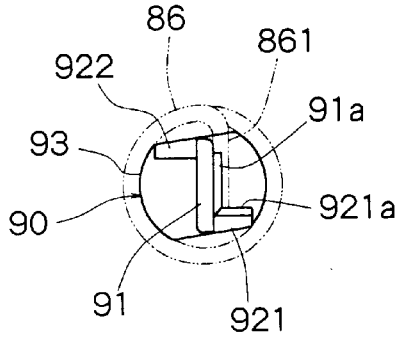
FIG. 10 is a side view of the vane member shown in FIG. 8.

In the second embodiment, a toner-scraping member 90 is fitted to the other end of the toner conveying member 86 in the form of a coil arranged in a compressed state in the toner conveying pipe 85, i.e., fitted to an end positioned in the toner discharge port 852. As shown in FIGS. 8 to 10, the toner-scraping member 90 is constituted by a vane 91 of a flat plate, fins 921 and 922 that protrude in opposite directions from both side edges of the vane 91, and a flange 93 formed in a protruding manner at one end of the vane 91. The toner-scraping member 90 is made of a suitable synthetic resin. The vane 91 of a flat plate has a diameter smaller than the inner diameter of the toner conveying member 86 in the form of a coil. The above-mentioned fins 921 and 922 protrude from both side edges of the vane 91 toward the direction of rotation of the toner conveying member 86 in the form of a coil. The vane 91 and the fins 921, 922 are so formed as to become narrow toward the other end thereof, so that they are easily inserted in the other end of the toner conveying member 86 in the form of a coil. The flange 93 has an end surface 931 of a conical shape, that is opposed to the plug 87. In connection with the end surface 931 formed in a conical shape of the flange 93, a recessed portion 871 of a conical shape is formed in the end surface, opposed to the flange 93, of the plug 87. By supporting the conical end surface 931 of the flange 93 by the recessed portion 871 of a conical shape of the plug 87, therefore, the center of rotation of the toner-scraping member 90 is rotatably supported, and the axes of the toner-scraping member 90 and the toner conveying member 86 are prevented from being deviated. Therefore, the toner-scraping member 90 and the toner conveying member 86 can be smoothly rotated. Besides, the slide friction is small since the contact area is small between the toner-scraping member 90 and the plug 87 which works as a support means. Moreover, since the plug 87 is made of a synthetic resin having a small coefficient of friction, the toner conveying member 86 is rotated without requiring an increased drive torque. In the illustrated embodiment, the end surface 931 of the flange 93 of the toner-scraping member 90 is formed in a conical shape, and the recessed portion 871 of a conical shape is formed in the end surface of the plug 87. It is, however, also allowable to form the end surface of the plug 87 in a conical shape and to form a recessed portion of a conical shape in the end surface 931 of the flange 93.

In the illustrated embodiment, protuberances 91*a* and 921*a* are formed as engaging means on one surface of the vane 91 of a flat plate and on the upper surface of one fin 921 constituting the toner-scraping member 90. The protuberances 91*a* and 921*a* are provided at positions at a distance from the flange 93, the distance corresponding to the thickness of the coil of the toner conveying member 86 in the form of a coil. Therefore, the toner-scraping member 90 is fitted to the other end portion of the toner conveying member 86 in the form of a coil, and a folded end 861 of the coil constituting the toner conveying member 86 in the form of a coil is engaged between the flange 93 and the protuberances 91*a*, 921*a*. Therefore, though a resistance to rotation is exerted on the toner conveying member 86 and on the vane member 90, the toner conveying member 86 is not liable to separate away from the toner-scraping member 90; i.e., the toner conveying member 86 and the toner-scraping member 90 can be rotated together as a unitary structure. In the illustrated embodiment, furthermore, by folding the end 861 of the coil constituting the toner conveying member 86 in the form of a coil and then simply being engaged between the flange 93 and the protuberances 91*a*, 921*a*, the toner conveying member 86 can be combined with the toner-scraping member 90, making it possible to accomplish the assembling operation very easily.

Described below is the operation of the device 8 for recovering toner constituted according to the second embodiment.

Like in the above-mentioned first embodiment, the toner 100 is conveyed by the toner conveying member 86 toward the toner discharge port 852 through the toner conveying pipe 85, scraped by the fins 921 and 922 constituting the toner-scraping member 90, and is permitted to fall into the toner recovery container 88 through a wide area of the toner discharge port 852 with the rotation of the toner-scraping member 90. Therefore, the toner recovery container 88 features an improved filling efficiency. Moreover, the vane 91 of a flat plate of the toner-scraping member 90 rotates together with the toner conveying member 86 in the form of a coil, and pushes the toner into the toner recovery container 88 through the toner discharge port 852 and the toner reception port 881. Accordingly, the toner moves into a vacant space in the toner recovery container 88, and the toner filling efficiency is further improved.

Further embodiments of the vane member mounted on the toner conveying member 86 in the form of a coil will be described with reference to FIGS. 11 and 12.

Figure 11:
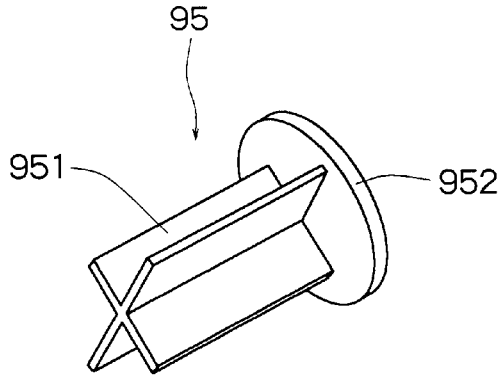
FIG. 11 is a perspective view of the vane member mounted on the toner conveyer mechanism in the device for recovering toner shown in FIG. 5 according to another embodiment of the present invention.
Figure 12:
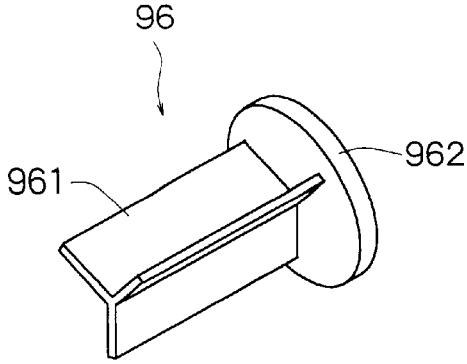
FIG. 12 is a perspective view of the vane member mounted on the toner conveyer mechanism in the device for recovering toner shown in FIG. 5 according to a further embodiment of the present invention.
Figure 13:
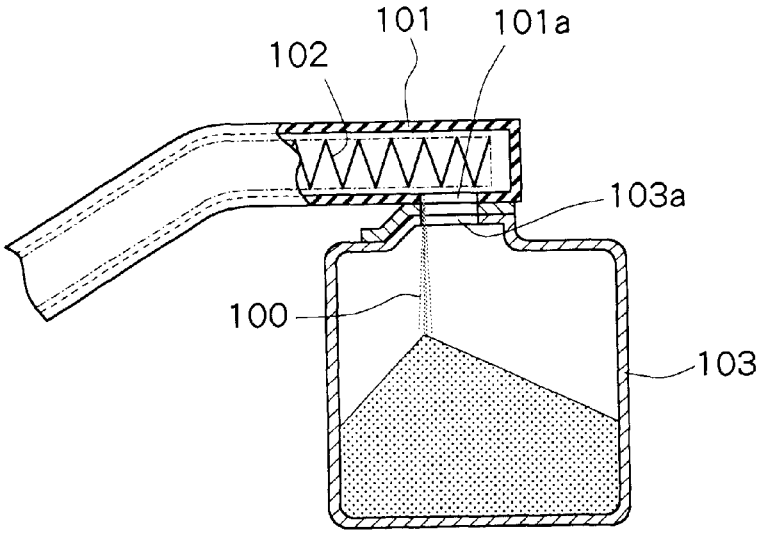
FIG. 13 ( PRIOR ART )
FIG. 13 is a sectional view illustrating major portions of a conventional device for recovering toner in a first state of operation.
Figure 14:
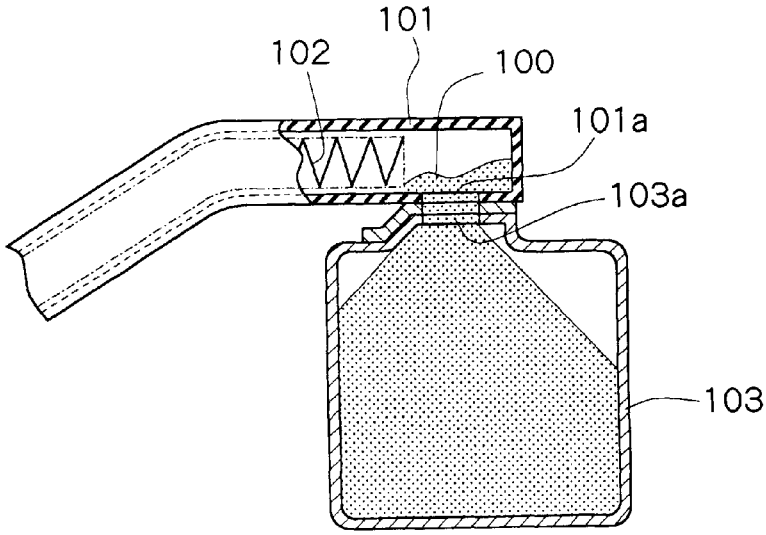
FIG. 14 ( PRIOR ART )
FIG. 14 is a sectional view illustrating major portions of the conventional device for recovering toner in a second state of operation.

The toner-scraping member 95 shown in FIG. 11 has four vanes 951 constituted in a cross shape, has a flange 952 at one end, and is constituted as a unitary structure by using a suitable synthetic resin. The vane member 96 shown in FIG. 12 has three vanes 961 constituted in a Y-shape, has a flange 962 at one end, and is constituted as a unitary structure by using a suitable synthetic resin. The toner-scraping members 95 and 96 shown in FIGS. 11 and 12 have plural vanes arranged in a radial manner, and hence, are capable of scraping the toner conveyed in the toner conveying pipe 85 toward the toner discharge port 852 and pushing the toner into the toner recovery container 88 through the toner discharge port 852 and the toner reception port 881. As described above, the toner-scraping member may be one that can scrape the toner in the toner conveying pipe 85 and push it into the toner recovery container 88. Therefore, various other modifications of the toner-scraping member can be contrived in addition to those of the above-mentioned embodiments without departing from the scope of the invention.

What we claim is:

1. A device for recovering toner in an image-forming machine, comprising a cleaning mechanism for removing toner that remains on an image carrier after a toner image has been transferred, a toner conveyer mechanism for conveying toner removed by said cleaning mechanism, and a toner recovery container for containing toner conveyed by said toner conveyer mechanism, wherein:

said toner conveyer mechanism includes a toner conveying pipe connected at its one end to said cleaning mechanism and having, at its other end, a toner discharge port that faces a toner reception port formed in said toner recovery container, and a toner conveying member in the form of a coil arranged in said toner conveying pipe, said coil being coupled at one end to a rotary member; and wherein said coil of said toner conveying member is arranged in a compressed state, and is supported at its other end by said other end of said toner conveying pipe by a support means having a low frictional resistance.

2. A device for recovering toner in an image-forming machine according to claim 1, wherein said support means is constituted by a plug fitted to said other end of said toner conveying pipe, said plug is formed of a material having a small coefficient of friction on a surface that is opposed to said other end of said toner conveying member, and said other end of said toner conveying member is brought into contact with said surface.

3. A device for recovering toner in an image-forming machine, comprising a cleaning mechanism for removing toner that remains on an image carrier after a toner image has been transferred, a toner conveyer mechanism for conveying toner removed by said cleaning mechanism, and a toner recovery container for containing toner conveyed by said toner conveyer mechanism, wherein:

said toner conveyer mechanism includes a toner conveying pipe connected at its one end to said cleaning mechanism and having, at its other end, a toner discharge port that faces a toner reception port formed in said toner recovery container, a toner conveying member in the form of a coil arranged in said toner conveying pipe, said coil being coupled at one end to a rotary member, and a toner-scraping member mounted on the other end of said toner conveying member to rotate together with said toner conveying member, wherein said toner-scraping member has a vane that fits to an inner peripheral side of said other end of said coil of said toner conveying member, and a flange provided at one end of said vane, and wherein an engaging means is provided on one surface of said vane at a position at a distance from said flange, said distance corresponding to a thickness of said coil of said toner conveyer member, said other end of said coil being engaged between said engaging means and said flange.

4. A device for recovering toner in an image-forming machine according to claim 3, wherein said toner-scraping member has plural vanes which are arranged in a radial manner.

5. A device for recovering toner in an image-forming machine according to claim 3, wherein fins are provided at side edges of said vane to protrude in a direction of rotation of said toner conveying member.

6. A device for recovering toner in an image-forming machine comprising a cleaning mechanism for removing toner that remains on an image carrier after a toner image has been transferred, a toner conveyer mechanism for conveying toner removed by said cleaning mechanism, and a toner recovery container for containing toner conveyed by said toner conveyer mechanism, wherein:

said toner conveyer mechanism includes a toner conveying pipe connected at its one end to said cleaning mechanism and having, at its other end, a toner discharge port that faces a toner reception port formed in said toner recovery container, a toner conveying member in the form of a coil arranged in said toner conveying pipe, said coil being coupled at one end to a rotary member, and a toner-scraping member mounted on the other end of said toner conveying member to rotate together with said toner conveying member, and wherein said coil of said toner conveying member is arranged in a compressed state, and said toner-scraping member is supported at said other end of said toner conveying pipe by using a support means having a small frictional resistance.

7. A device for recovering toner in an image-forming machine according to claim 6, wherein:

said toner-scraping member has a vane fitted to an inner periphery of said other end of said coil of said toner conveying member, and a flange provided at an end of said vane;

said support means is constituted by a plug fitted to said other end of said toner conveying pipe; and at least one of said plug or said flange of said toner-scraping member is made of a material having a small coefficient of friction, and said flange is supported upon coming in contact with said plug.

8. A device for recovering toner in an image-forming machine according to claim 6, wherein said toner-scraping member has a vane fitted to an inner periphery of said other end of said coil of said toner conveying member, and a flange provided at an end of said vane;

said support means is constituted by a plug fitted to said other end of said toner conveying pipe; and either an end surface of said flange of said toner-scraping member or an end surface of said plug opposed thereto is formed in a conical shape, a recessed portion is formed in the other end surface, and said flange is supported upon coming in contact with said plug.

* * * * *